US009593531B2

(12) United States Patent
Ballard et al.

(10) Patent No.: US 9,593,531 B2
(45) Date of Patent: Mar. 14, 2017

(54) LADDER SECURING APPARATUS, LADDERS INCORPORATING SAME AND RELATED METHODS

(71) Applicant: Wing Enterprises, Incorporated, Springville, UT (US)

(72) Inventors: Jay Ballard, Mapleton, UT (US); Sean R. Peterson, Santaquin, UT (US); Gary M. Jonas, Springville, UT (US); N. Ryan Moss, Mapleton, UT (US); Ryan Crawford, Salem, UT (US); Benjamin Cook, Provo, UT (US); Brian B. Russell, Salt Lake City, UT (US)

(73) Assignee: Wing Enterprises, Inc., Springville, UT (US)

( * ) Notice: Subject to any disclaimer, the term of this patent is extended or adjusted under 35 U.S.C. 154(b) by 9 days.

(21) Appl. No.: 14/490,431

(22) Filed: Sep. 18, 2014

(65) Prior Publication Data

US 2015/0075905 A1 Mar. 19, 2015

Related U.S. Application Data

(60) Provisional application No. 61/879,508, filed on Sep. 18, 2013.

(51) Int. Cl.
*E06C 7/48* (2006.01)
*E06C 1/36* (2006.01)

(52) U.S. Cl.
CPC . *E06C 7/48* (2013.01); *E06C 1/36* (2013.01)

(58) Field of Classification Search
CPC ..... E06C 7/48; E06C 1/36
See application file for complete search history.

(56) References Cited

U.S. PATENT DOCUMENTS 283,530 A * 8/1883 Swartz ..... E06C 7/12 182/102
285,637 A 9/1883 Makahak
(Continued)

FOREIGN PATENT DOCUMENTS

CN 201502313 U 6/2010
CN 201802297 U 4/2011
(Continued)

OTHER PUBLICATIONS

PCT International Search Report for corresponding PCT International Patent Application No. PCT/US2014/056326, mailed Dec. 31, 2014.

(Continued)

*Primary Examiner* — Alvin Chin-Shue
(74) *Attorney, Agent, or Firm* — Holland & Hart, LLP

(57) ABSTRACT

A ladder is provided having a securing apparatus for securing the ladder to a horizontally extending support structure (e.g., a utility cable), a vertically extending support structure (e.g., a utility pole) or both. In accordance with one embodiment, the securing apparatus includes a pair of spaced apart engagement mechanisms, wherein each engagement mechanism is pivotally coupled with an associated rail of the ladder. Each engagement mechanism includes a frame member, an engagement member pivotally coupled with the frame member and a pole grasping structure coupled with the frame member. In one embodiment, each engagement member is configured to rotate from a first position, wherein an open gate is formed between the engagement member and its associated frame member, to a closed position.

10 Claims, 14 Drawing Sheets

(56) References Cited

U.S. PATENT DOCUMENTS

| | | | | |
|---|---|---|---|---|
| 1,205,594 | A | 11/1916 | Close | |
| 1,386,511 | A | 8/1921 | Krahl | |
| 1,522,292 | A | 1/1925 | Enssle | |
| 1,813,865 | A | 7/1931 | Reese | |
| 1,961,289 | A | 6/1934 | Gardner | |
| 2,008,895 | A | 7/1935 | Norris | |
| 2,432,781 | A | 12/1947 | Mann | |
| 2,439,430 | A | 4/1948 | Hurd | |
| 2,536,318 | A | 1/1951 | Siler | |
| 2,797,037 | A | 6/1957 | Niedojadlo | |
| 2,797,038 | A | 6/1957 | Tiberghien | |
| 2,910,135 | A | 10/1959 | Moore | |
| 3,037,579 | A | 6/1962 | Barrow | |
| 3,115,211 | A | 12/1963 | Ostrander Jr. | |
| 3,136,384 | A | 6/1964 | Alexander | |
| 3,336,999 | A * | 8/1967 | McSwain | A45F 3/26 182/106 |
| 3,486,580 | A | 12/1969 | Norton | |
| 3,603,431 | A | 9/1971 | Nameche et al. | |
| 3,910,380 | A | 10/1975 | Nameche et al. | |
| 3,917,189 | A | 11/1975 | Bryll et al. | |
| 4,090,587 | A | 5/1978 | Pyle | |
| 4,128,228 | A | 12/1978 | Ziegelmann | |
| 4,257,492 | A | 3/1981 | Rasada et al. | |
| 4,279,327 | A | 7/1981 | Warren et al. | |
| 4,311,209 | A | 1/1982 | Primerano et al. | |
| 4,515,242 | A | 5/1985 | LaChance | |
| 4,531,612 | A | 7/1985 | Sandor | |
| 4,531,613 | A | 7/1985 | Keigher et al. | |
| 4,552,246 | A * | 11/1985 | Thomas | A01M 31/02 182/116 |
| 4,593,790 | A | 6/1986 | Brewer et al. | |
| 4,995,476 | A * | 2/1991 | Buck | E06C 7/48 182/107 |
| 5,054,581 | A | 10/1991 | Henson | |
| 5,285,868 | A | 2/1994 | Amacker | |
| 5,429,207 | A | 7/1995 | Frank et al. | |
| 5,601,154 | A | 2/1997 | Eisenmenger et al. | |
| 5,850,894 | A | 12/1998 | Busenhart et al. | |
| 5,855,251 | A | 1/1999 | Deuer | |
| 5,911,287 | A | 6/1999 | Campbell | |
| 6,019,191 | A | 2/2000 | Flores | |
| 6,021,865 | A | 2/2000 | Thompson et al. | |
| 6,029,774 | A | 2/2000 | Cothern et al. | |
| 6,044,930 | A | 4/2000 | Hayman | |
| 6,138,794 | A | 10/2000 | Staal et al. | |
| 6,158,549 | A | 12/2000 | Hartman | |
| 6,244,382 | B1 * | 6/2001 | Labonte | E06C 7/48 182/107 |
| 6,250,424 | B1 | 6/2001 | Laug et al. | |
| 6,883,642 | B2 | 4/2005 | Matty | |
| 7,219,766 | B2 * | 5/2007 | Deuer | E06C 1/36 182/10 |
| 8,011,476 | B1 * | 9/2011 | Alcon | E06C 1/36 182/116 |
| 8,776,947 | B1 * | 7/2014 | Wurth | E06C 1/12 14/69.5 |
| 2005/0045421 | A1 | 3/2005 | Gaines | |
| 2005/0284703 | A1 | 12/2005 | Deuer | |
| 2008/0202851 | A1 | 8/2008 | Schwenke et al. | |
| 2009/0000868 | A1 | 1/2009 | Gaines | |
| 2009/0242328 | A1 | 10/2009 | Cabrera et al. | |
| 2010/0038172 | A1 | 2/2010 | Ralston | |
| 2010/0213009 | A1 | 8/2010 | Guinovart et al. | |
| 2010/0300805 | A1 | 12/2010 | Moss et al. | |
| 2010/0326768 | A1 * | 12/2010 | Kerstetter, Jr. | E06C 7/48 182/5 |
| 2014/0105575 | A1 | 4/2014 | Nishikawa et al. | |

FOREIGN PATENT DOCUMENTS

| | | | | |
|---|---|---|---|---|
| EP | 232206 | A2 | 8/1987 | |
| EP | 0771931 | A1 * | 5/1997 | E06C 1/34 |
| GB | 1340224 | | 12/1973 | |
| GB | 2459118 | A | 10/2009 | |
| GB | 2480890 | A | 12/2011 | |
| JP | 2000248865 | A | 9/2000 | |

OTHER PUBLICATIONS

Moss et al, U.S. Appl. No. 61/879,506, 28 pages, filed Sep. 18, 2013.

PCT International Search Report for PCT International Patent Application No. PCT/US2013/063927, mailed Jan. 16, 2014.

Lansford Acess Ltd, Industrial Alloy Shelf Ladders, 2013. Obtained from http://www.ladders-999.co.uk/downloads/ShelfLadders2013.pdf on Nov. 10, 2014.

APC, Ladder Bracket Kit (AR8168BLK)—Installation. Obtained from http://www.apcmedia.com/salestools/ASTE-6Z6KB3/ASTE-6Z6KB3_R0_EN.pdf on Nov. 10, 2014.

Houzz, MWE—Hook Ladder, available as early as Feb. 2013. Obtained from http://www.houzz.com/photos/1877868/MWE-Hook-Ladder-KLASSIK-modern-living-room-vancouver, on Nov. 10, 2014.

Bit Rock Supply, Roofers World Ladder Mount. Obtained from https://www.bigrocksupply.com/store/p/8580-Roofers-World-Ladder-Mount.aspx, on Nov. 10, 2014.

Definition of "Width", The American Heritage Dictionary of the English Language, 4th Edition, 2000, Houghton Mifflin Company, udpated in 2009.

Definition of "Adjacent", Collins English Dictionary—Complete and Unabridged, Harper Collins, 1991.

English abstract and English machine translation of the specification and claims of CN 201502313. Jun. 9, 2010.

English abstract and English machine translation of the specification and claims of CN 201802297. Apr. 20, 2011.

English abstract and English machine translation of the specification and claims of JP 2000248865. Sep. 12, 2000.

English abstract and English machine translation of the specification and claims of EP 0232206. Aug. 12, 1987.

* cited by examiner

LADDER SECURING APPARATUS, LADDERS INCORPORATING SAME AND RELATED METHODS

CROSS-REFERENCE TO RELATED APPLICATIONS

The present application claims benefit to U.S. Provisional Patent Application No. 61/879,508, filed Sep. 18, 2013, the disclosure of which is incorporated by reference herein in its entirety.

BACKGROUND

Ladders are conventionally utilized to provide a user thereof with improved access to elevated locations that might otherwise be inaccessible. Ladders come in many shapes and sizes, such as straight ladders, straight extension ladders, stepladders, and combination step and extension ladders. So-called combination ladders may incorporate, in a single ladder, many of the benefits of multiple ladder designs.

Ladders known as straight ladders or extension ladders are ladders that are conventionally not self-supporting but, rather, are positioned against an elevated surface, such as a wall or the edge of a roof, to support the ladder at a desired angle. A user then ascends the ladder to obtain access to an elevated area, such as access to an upper area of the wall or access to a ceiling or the roof. A pair of feet or pads, each being coupled to the bottom of an associated rail of the ladder, are conventionally used to engage the ground or some other supporting surface.

In certain industries, such as in the telecommunications industry, ladders are used to access overhead cables or utility lines (e.g., cables or wires used for telephones, cable television, etc). In such cases, the ladders are sometimes supported at their upper ends by a utility pole or other vertical structure. In some situations, the upper end of the ladder is actually supported by a utility line extending generally horizontally between adjacent utility poles or towers. In such cases, the ladders have conventionally been fitted with v-braces and/or "cable hooks" (or "strand hooks"). V-braces conventionally include a V-shaped structure configured to receive a portion of a utility pole or similar structure when the ladder is positioned against the pole. However, if the ladder is jostled, bumped or otherwise shifts, the v-brace can easily become disengaged from the pole as it only abuts or contacts the pole along the two inner surfaces of the v-brace.

Cable hooks are conventionally attached to the top of the ladder and simply hook over the top of the utility cable. The top of the ladder, thus, rests against and is supported by the horizontally extending utility cable. However, while the cable hooks generally engage the utility cable to provide support to the ladder, if the ladder shifts or tilts relative to utility cable (e.g., because of unstable ground or because of the user of the ladder leaning out too far to the side and causing the loading on the ladder to be unbalanced), one or both of the cable hooks may disengage the utility cable such that the ladder loses support and stability. This obviously creates a dangerous situation for the user of the ladder.

Thus, there is a continuing desire in the industry to provide improved functionality of ladders while also improving the safety and stability of such ladders.

SUMMARY

Ladders, ladder components and related methods are provided herein. In accordance with one embodiment, a ladder comprises a first pair of spaced apart rails, a plurality of rungs extending between and coupled to the first pair of spaced apart rails and a securing apparatus. The securing apparatus includes a pair of spaced apart engagement mechanisms, each engagement mechanism being pivotally coupled with an associated rail of the first pairs of spaced apart rails, each engagement mechanism including a frame member, an engagement member pivotally coupled with the frame member and a pole grasping structure coupled with the frame member.

In one embodiment, the ladder further comprises a ratchet mechanism associated with each of the pivotal engagement mechanisms.

In one embodiment, each engagement member is configured to rotate from a first position, wherein an open gate is formed between the engagement member and its associated frame member, to a closed position wherein the engagement member and the frame member cooperatively form an enclosed structure.

In one embodiment, each engagement mechanism further includes a retaining mechanism configured to selectively maintain the engagement member in the closed position.

In one embodiment, the ladder further comprises a release mechanism configured to actuate at least one of the retaining mechanism and the ratchet mechanism. In one particular embodiment, the release mechanism is configured to actuate both the retaining mechanism and the ratchet mechanism.

In one embodiment, the engagement mechanisms are configured to rotate into a stored position wherein the engagement mechanisms are substantially positioned within an envelope defined by the spaced apart rails.

In one embodiment, the ladder further comprises an actuating mechanism comprising a cross-member coupled with the engagement mechanisms such that, upon displacement of the cross-member, the engagement mechanisms rotate from an open position toward a closed position. In one particular embodiment, the actuating mechanism includes a pair of link members, each link member having a first end coupled with the cross-member and a second end coupled with an associated one of the pair of engagement members.

In one embodiment, the cross-member of the actuating mechanism includes v-shaped portion and at least one engagement feature.

In one embodiment, the ratchet mechanisms are configured to enable rotation of the engagement mechanisms in a first direction but selectively inhibit rotation of the engagement mechanisms in a second, opposite direction.

In one embodiment, the ratchet mechanisms are configured to selectively maintain the engagement mechanisms in a plurality of rotational positions between the open position and the closed position.

In one embodiment, the ladder further includes a biasing member configured to bias the engagement mechanisms toward the open position.

In one embodiment, each pole grasping structure includes at least on engagement feature.

In one embodiment, the ladder further comprises a second pair of spaced apart rails slidably coupled with the first pair of spaced apart rails and a plurality of rungs extending between and coupled to the second pair of spaced apart rails.

In accordance with one embodiment of the invention, a ladder is provided that comprises a first pair of spaced apart rails, a plurality of rungs extending between and coupled to the first pair of spaced apart rails, a first structural component pivotally coupled with a first rail of the pair of rails, second structural component coupled with a second rail of the pair of rails; and a cross-member having a v-shaped portion configured to engage a vertical support structure, the cross member being coupled the first structural component and the second structural component.

In one embodiment, the ladder further comprises a first structure pivotally coupled with the first rail. a second structure pivotally coupled with the second rail, a first link coupling the first structure with the cross-member, and a second link coupling the second structure with the cross-member, wherein displacement of the cross-member effects pivoting of the first and second structures relative to the first and second rails, respectively.

In one embodiment, the first structure pivots about an axis that is substantially parallel to a longitudinal axis of the first rail and wherein the second structure pivots about an axis that is substantially parallel to a longitudinal axis of the second rail.

In one embodiment, the first and second structures each include engagement features configured to engage a vertical support member.

In one embodiment, the first and second structures each include a frame member and an engagement member pivotally coupled with the frame member, the engagement member being configured to rotate from a first position, wherein an open gate is formed between the engagement member and the frame member, to a closed position wherein the engagement member and the frame member cooperatively form an enclosed structure.

In accordance with another embodiment, a ladder is provided that comprises a first pair of spaced apart rails, a plurality of rungs extending between and coupled to the first pair of spaced apart rails and a securing apparatus pivotally coupled with the first pair of spaced apart rails. The securing apparatus comprises an engagement arm having a first section, a second section extending from the first section at a defined angle, and a third section extending from the second section at a defined angle, wherein the engagement arm defines an open gate area between the first section and the second section. The securing apparatus further includes at least one engagement feature on the first section of the engagement arm and at least one engagement feature on the third section of the engagement arm.

In one embodiment, the at least one engagement feature on the first section of the engagement arm includes a pair of spaced apart discs coupled with the first section, wherein each of the pair of discs includes a plurality of teeth along a radially outer periphery thereof.

In one embodiment, the at least one engagement feature on the third section of the engagement arm includes a plurality of teeth arranged along a v-shaped surface associated with the third section.

In one embodiment, the second section of the engagement arm is configured to extend away from the first pair of spaced apart rails at an acute angle relative to a plane defined by the first pair of spaced apart rails when the securing apparatus is not engaged with a vertical support structure.

It is noted that the embodiments described herein are not to be considered mutually exclusive of one another and that any feature, aspect or component of one embodiment described herein may be combined with other features, aspects or components of other embodiments.

BRIEF DESCRIPTION OF THE DRAWINGS

The foregoing and other advantages of the invention will become apparent upon reading the following detailed description and upon reference to the drawings in which.

DETAILED DESCRIPTION

Various embodiments of ladders and ladder components are described herein. The described embodiments are not mutually exclusive of each other. Rather, various features of one described embodiment may be used in conjunction with features of other described embodiments. Additionally, features of the described embodiments may be used in conjunction with, or as an alternative to, those described in U.S. patent application Ser. No. 14/049,927 filed on Oct. 9, 2013 (hereinafter "the '927 Application"), the disclosure of which is incorporated by reference herein in its entirety.

Figure 1:
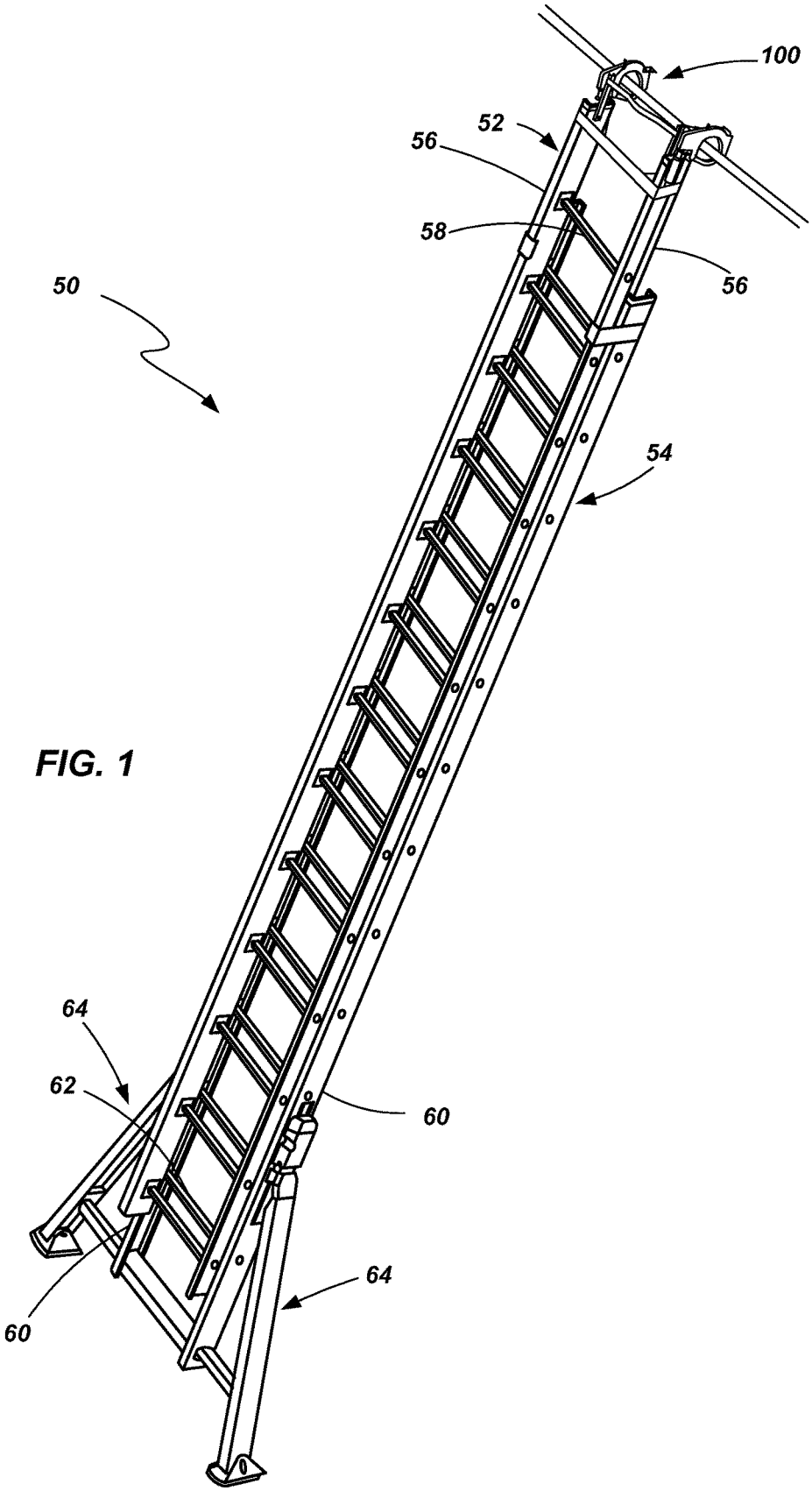
FIG. 1 is a perspective view of a ladder having a securing apparatus according to an embodiment of the present invention.

Referring now to FIG. 1, a ladder 50 is shown that includes a securing apparatus 100 which will be described in further detail below. The ladder 50 is configured as an extension ladder and includes a first assembly 52 (sometimes referred to as a fly section) and a second assembly 54 (sometimes referred to as a base section) slidably coupled with the first assembly 52. The first assembly 52 includes a pair of spaced apart rails 56 with a plurality of rungs 58 extending between, and coupled to, the rails 56. Similarly, the second assembly 54 includes a pair of spaced apart rails 60 with a plurality of rungs 62 extending between, and coupled to, the rails 60. While not specifically shown in the drawings, one or more mechanisms—often referred to as a rung lock—may be associated with the first and second assemblies 52 and 54 to enable selective positioning of the first assembly 52 relative to the second assembly 54. This enables the ladder 50 to assume a variety of lengths (or, more specifically, heights when in an intended operating orientation) by sliding the first assembly 52 relative to the second assembly 54 and locking the two assemblies in a desired position relative to one another. By selectively adjusting the two rail assemblies 52 and 54 relative to each other, a ladder can be extended in length to nearly double its collapsed or shortest state, as will be appreciated by those of ordinary skill in the art. By way of example, a rung lock apparatus is described in U.S. Pat. No. 5,429,207 to Frank et al., issued Jul. 4, 1995, the disclosure of which is incorporated by reference herein in its entirety.

In many conventional extension ladders, feet members may be coupled to the lower ends of the rails 60 to support the ladder on the ground or other surface. Such a configuration may be used in embodiments of the present invention. In other embodiments, such as the specific embodiment shown FIG. 1, adjustable support members 64 are coupled with the second assembly 54 to provide increased lateral stability as well as the ability to adjust the ladder for placement on uneven surfaces. An example of such adjusting members is described in U.S. Patent Application Publication No. U.S. 20100300805 (application Ser. No. 12/714,313) published on Dec. 2, 2010, the disclosure of which is incorporated by reference herein in its entirety. Again, as noted above, the present invention is not limited to particular types of ladders and may be implemented in conjunction with conventional extension ladders, straight ladders or even combination ladders if desired.

Figure 2:
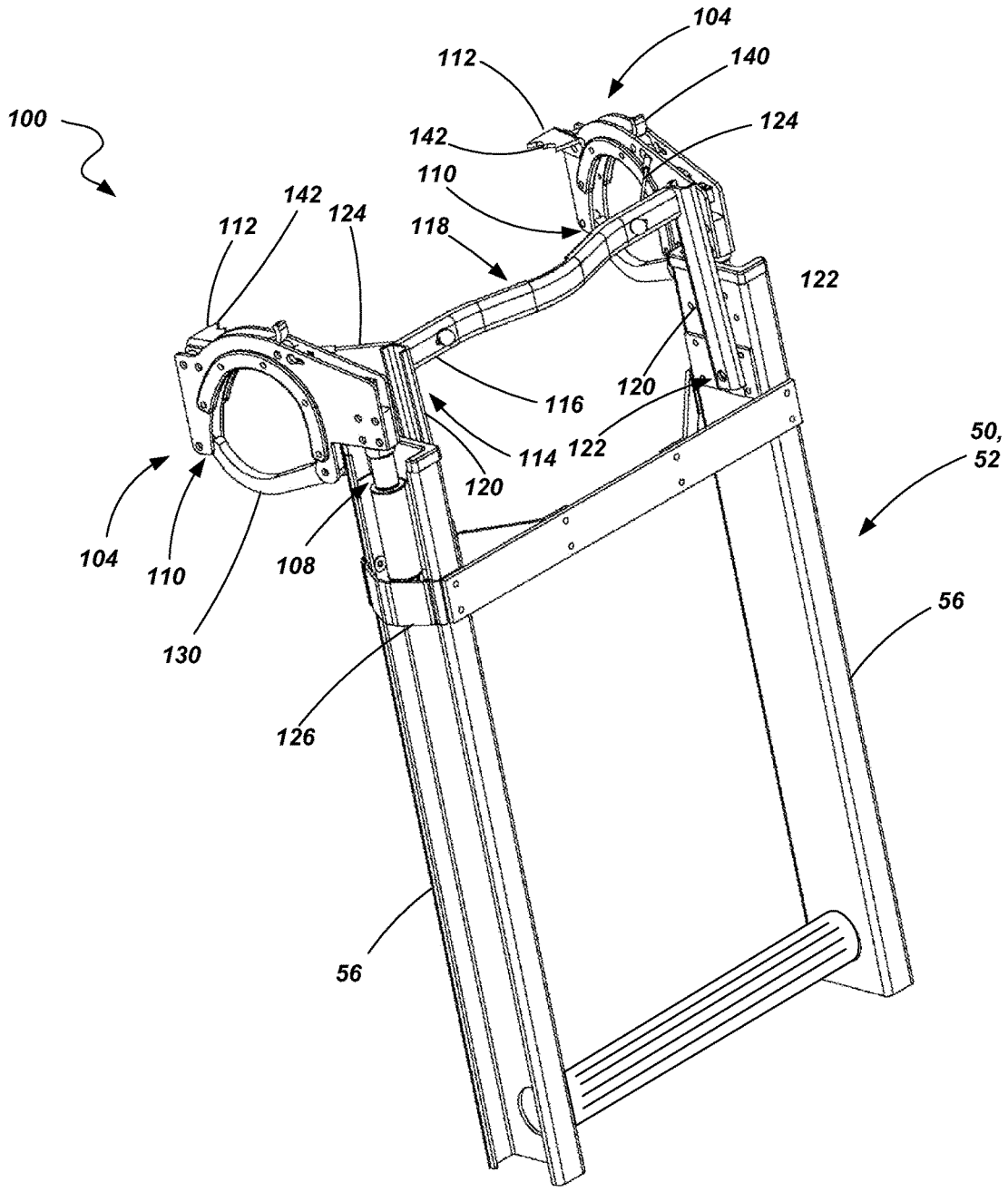
FIG. 2 is an enlarged perspective view of a securing apparatus coupled with an upper portion of a ladder according to an embodiment of the present invention.
Figure 3:
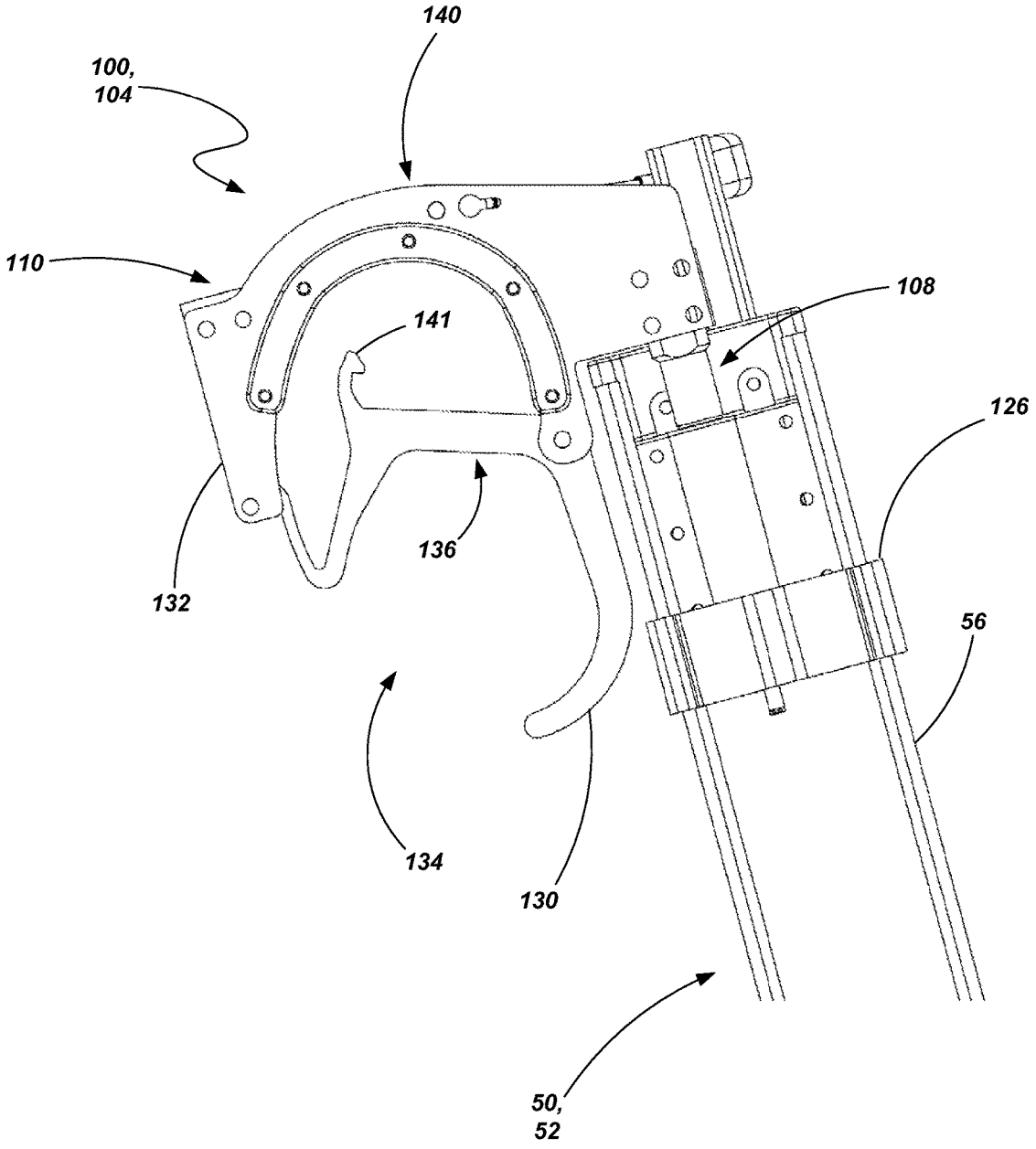
FIG. 3 is side view of the apparatus shown in FIG. 2 in a first state.
Figure 4:
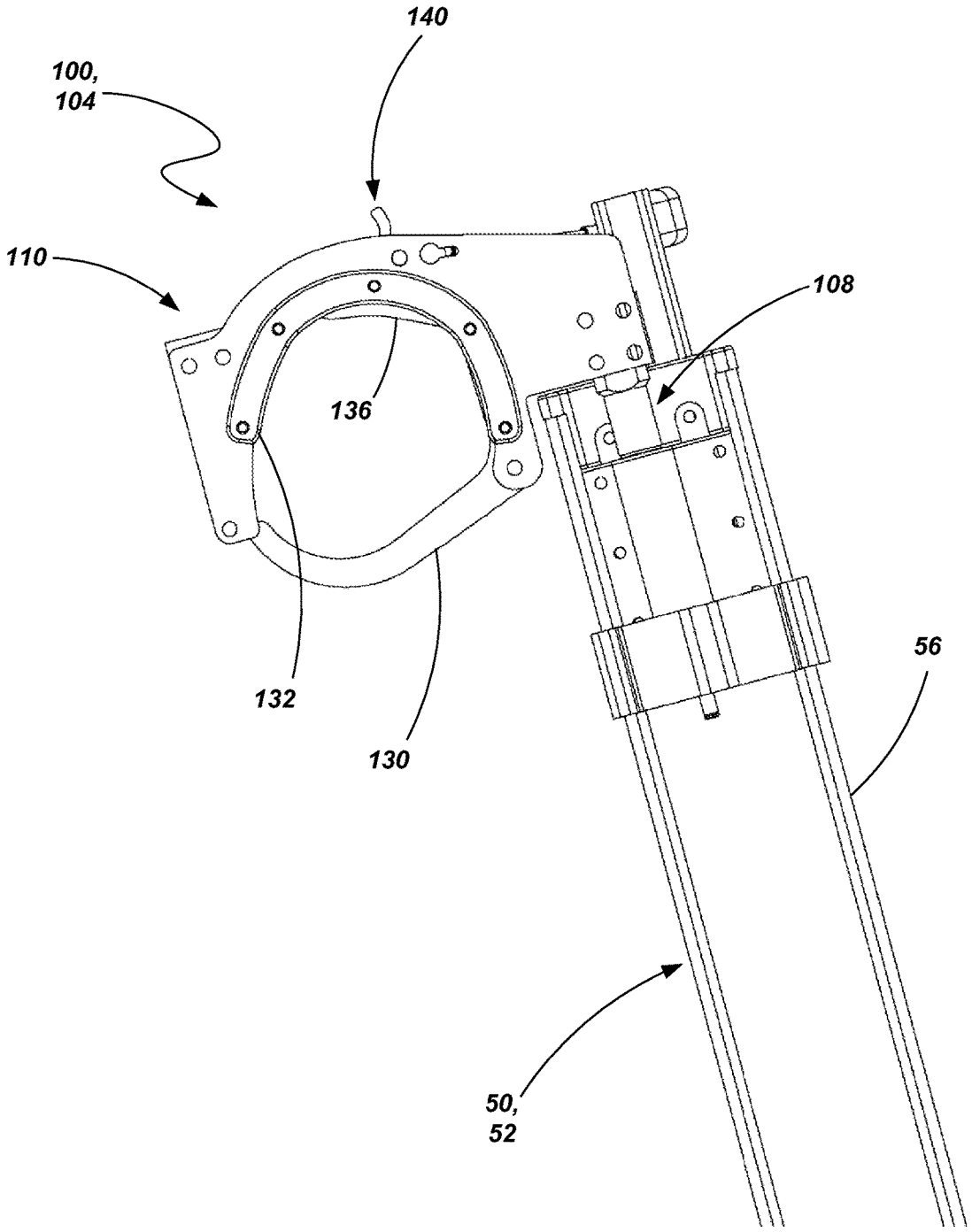
FIG. 4 is a side view of the apparatus shown in FIG. 2 in a second state.

Referring now to FIGS. 2-4, a securing apparatus 100 is shown for use with a ladder (only the upper portion of the first assembly 52 of which is shown in FIGS. 2-4) when it is desired to support the ladder using either a generally horizontally extending overhead line (e.g., a utility line such as used in the telecommunications industry) or a generally vertically extending structure such as a utility pole. The apparatus 100 includes two spaced apart engagement mechanisms 104. Each engagement mechanism 104 is coupled with an associated rail 56 of the ladder 50 by a pivoting structure 108. In one embodiment, the pivoting mechanisms are positioned adjacent the laterally outer surface of the rails 56 and configured so that each engagement mechanism 104 may pivot about an axis that extends substantially parallel to their associated rail 106. The engagement mechanisms 104 include a cable grasping mechanism 110 configured to circumscribe a cable or other horizontal structure as will be described in further detail below. Additionally, the engagement mechanisms 104 each include a pole grasping structure 112 to engage a utility pole or other vertical structure as will be additionally described below.

An actuating mechanism 114 may include a cross-member 116 which may be configured generally as a v-brace or otherwise include a v-shaped portion 118 configured to engage a vertical structure. The cross-member 116 is coupled to two rails 120, with each rail 120 being coupled to an associated ladder rail 106 by way of a pivoting connection 122. Each engagement mechanism 104 is coupled with the cross-member 116 by way of a linking member 124. A brace 126 may extend between and be coupled with the rails 106 of the ladder 50 to provide a substantially rigid framework to which the engagement mechanism is coupled.

Referring more specifically to FIG. 3, a side view is shown of the securing apparatus 100 and upper portion of the ladder 50. The engagement mechanism 104 (or more specifically, the cable grasping mechanism 110 of the engagement mechanism 104) is shown in an "open" position or state wherein a cable engaging member 130 is rotated downward from a hooked or curved frame member 132. The engaging member 130 is pivotally coupled with the frame member 132, the two components cooperating with one another to encircle a cable member (or other horizontally extending component) when the engaging member 130 is rotated to a closed state or position, such as shown in FIG. 4. When in an "open" position, the cable grasping mechanism provides an open gate 134 through which a cable or other horizontal member may pass through when a user is positioning the ladder 50. The user may then manipulate the ladder 50 such that a central portion 136 of the engaging member 130 contacts or engages the cable. Once engaged with the cable or other member, further positioning (e.g., lowering) of the ladder 50 causes the cable to push upwards on the central portion 136 of the engaging member 130 (by virtue of the weight of the ladder 50 pulling downwards), resulting in the engaging member 130 rotating relative to the frame member 132 and closing such as shown in FIG. 4. When closed, the gate 134 of the engaging member overlaps with (or is covered by) a portion of the frame member 132 such that the engaging member 130 and frame member 132 circumscribe the cable or support member.

In one embodiment, the engagement mechanisms 104 may be configured to affirmatively grasp the cable or support member. Such an embodiment is described in the '927 Application. Additionally, such as described in the '927 Application, the engagement mechanisms 104 may be configured to maintain engagement with (or circumscription of) the cable simply by gravity with the cable effectively pushing upwards on the central portion 136 of the engaging member 130.

In other embodiments, such as shown in FIGS. 3 and 4, the engagement mechanisms 104 may be configured to circumscribe the cable without necessarily grasping it. Additionally, the grasping mechanisms 110 may be configured to affirmatively lock, such as by way of a catch member or other retaining mechanism 140 that engages a catch member 141 or other portion of the engaging members 130 (see FIG. 3). In such a case, a user may release the engaging members 130 either by actuating the retaining mechanism 140 prior to descending the ladder 50 or, alternatively, by way of a remote mechanism after ascending the ladder 50. Such a remote mechanism may include a pull cord, a shaft or some other appropriate structure configured to release the retaining mechanism 140. In one embodiment, a shaft or other structure may extend between the retaining mechanism 140 and the bottom of the ladder 50 and be configured such that upon lifting of the ladder off the ground (or other support surface) the shaft drops and automatically releases the retaining mechanism (or actuates a release mechanism).

Figure 5A:
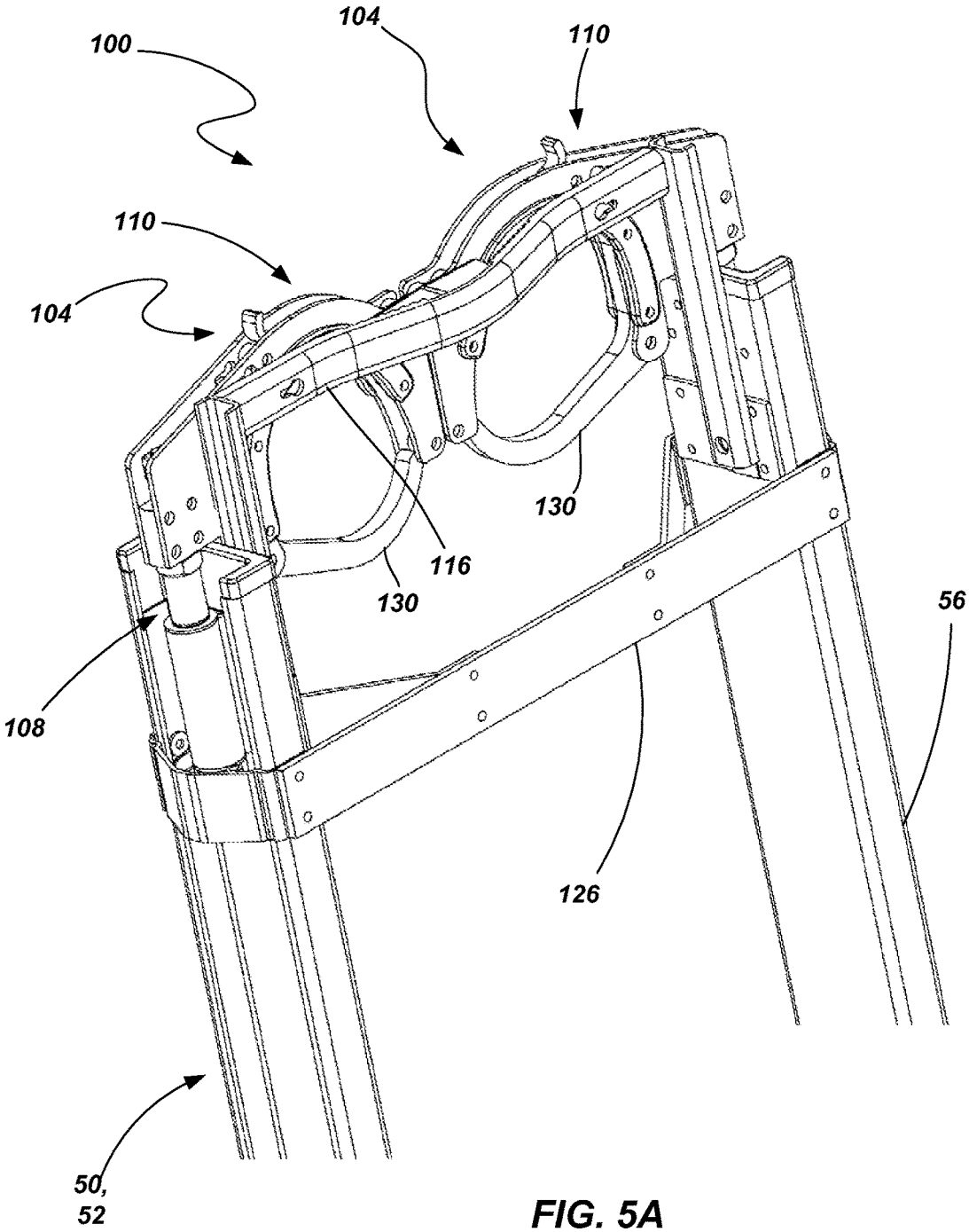
FIGS. 5A and 5B are perspective and top views of the apparatus and ladder shown in FIG. 1 in a stored or collapsed state.
Figure 5B:
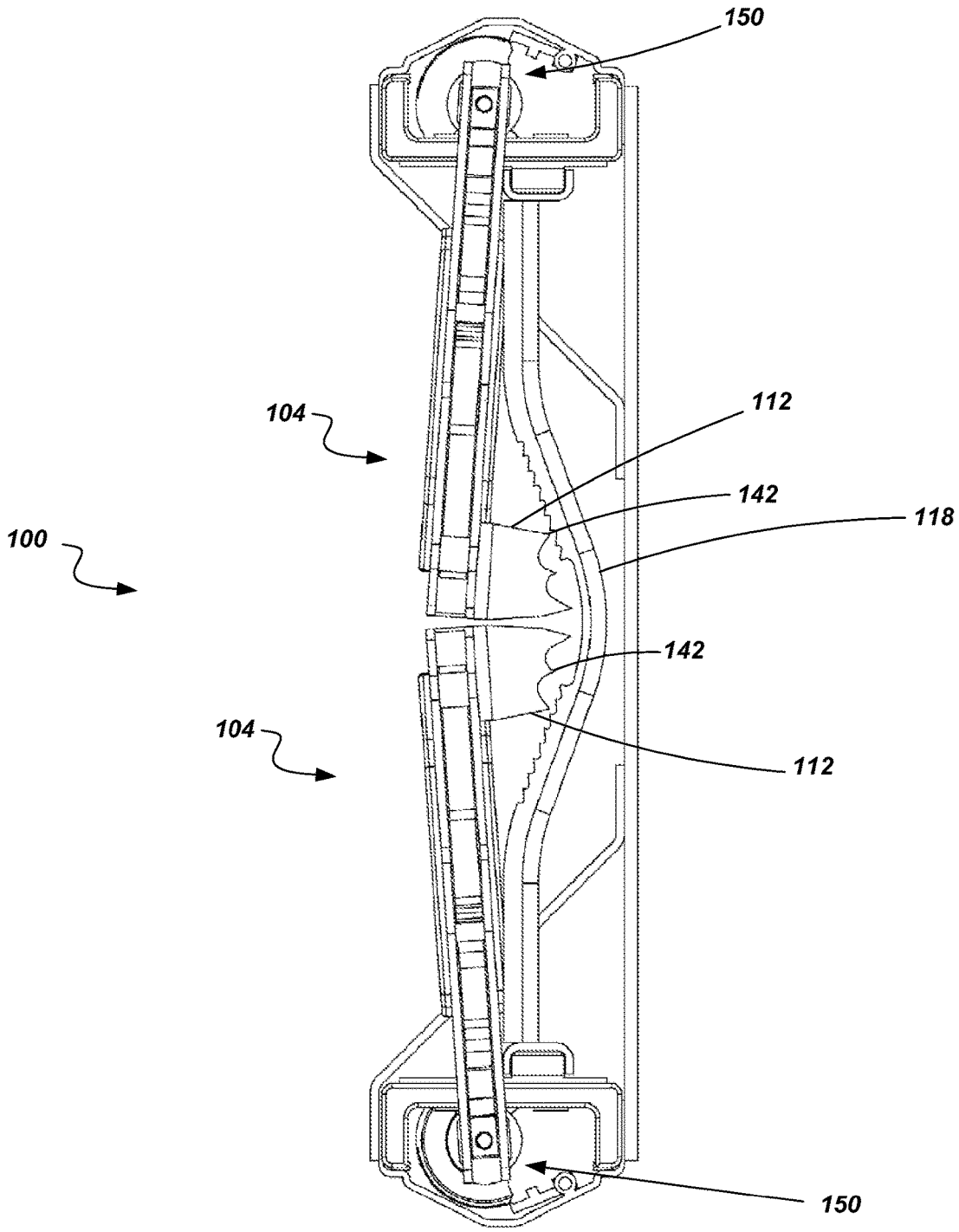

The engagement mechanisms 104 may each be rotated about the pivot structures 108 to a closed or storage position such as shown in FIGS. 5A and 5B. When in this state, the pole grasping structures 112 (which may include teeth, barbs, a serrated edge or other engaging features 142 used to help grasp a pole), are tucked within the space defined by the v-shaped portion 118 of the cross-member 116. This places the pole grasping structures 112 in a position that will minimize potential inadvertent scraping, puncturing or catching on other surfaces when transporting and storing the ladder 50. Similarly, the placement of the engagement members 104 may also help to cover or protect barbs, teeth, or other engaging features that may be formed on the v-shaped portion 118 of the cross-member 116.

As seen in FIG. 5B, an adjustable locking device, such as a ratcheting mechanism 150, may be associated with the pivoting structures 108 to lock the engagement mechanisms at a variety of different rotational positions as will be discussed further below. In one embodiment, one or more biasing members may be associated with the engagement mechanisms 104 to bias them towards the open position.

In one embodiment, the release mechanism discussed above with respect to the retaining mechanism 140 may also be used to release the ratchet mechanism 150, thereby releasing the engagement mechanisms 104 from their stored positions (or other rotational positions) to a released position such as shown in FIG. 2. In other embodiments, separate release mechanisms may be used to actuate the retaining mechanism 140 or to actuate (e.g., release) the ratcheting mechanism 150.

Referring to FIGS. 6A-6E, the operation of the engagement mechanisms 104 to grasp a vertical structure (e.g., a utility pole) is shown. The engagement mechanisms 104 may be used to engage vertical structures of varying sizes. For example, referring first to FIG. 6A, a utility pole 160 having a relatively small diameter (e.g., approximately 6 inches) is shown. When the ladder 50 is positioned against the pole 160, it abuts the v-shaped portion 118 of the cross-member 116, causing the cross-member and associated rails 120 to pivot about their respective pivoting connections 122. As the cross-member 116 is displaced, it pulls on linking members 124 coupled between the cross-member 116 and engagement mechanisms 104, causing the engagement mechanisms 104 to rotate about their pivoting structures 108 until the pole grasping structures 112 contact and engage the pole 160. As noted above, a ratchet mechanism 150 may be used to lock or maintain the engagement mechanisms 104 in their inwardly rotated positions, thus, maintaining engagement of the pole grasping structures 112 with the pole 160. In other embodiments, gravity and force of the ladder 50 pushing against the pole 160 (including the cross-member 116 engaging the pole 160) may be relied upon to maintain the engaged position of the engagement mechanisms 104 including the pole grasping structures 112. In the instance depicted in FIG. 6A (i.e., with regard to a small diameter pole 160), the pole grasping structures 112 engage the pole 160 at a rear surface of the pole 160 with the pole 160 nearly being enclosed by the cross-member 116 and the engagement mechanisms 104.

Figure 6A:
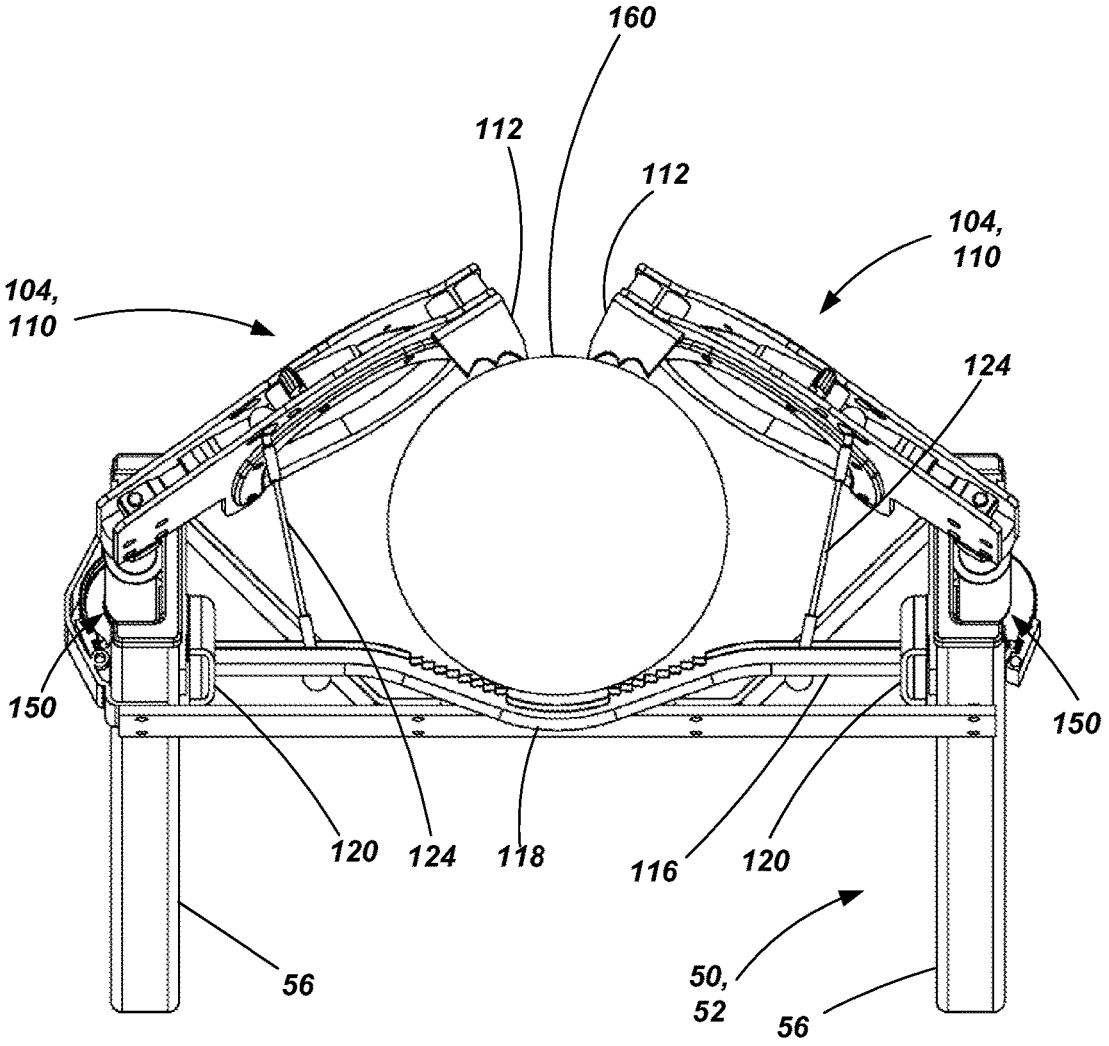
FIGS. 6A-6E are top views of the apparatus and ladder shown in FIG. 1 while in a variety of states or positions.
Figure 6B:
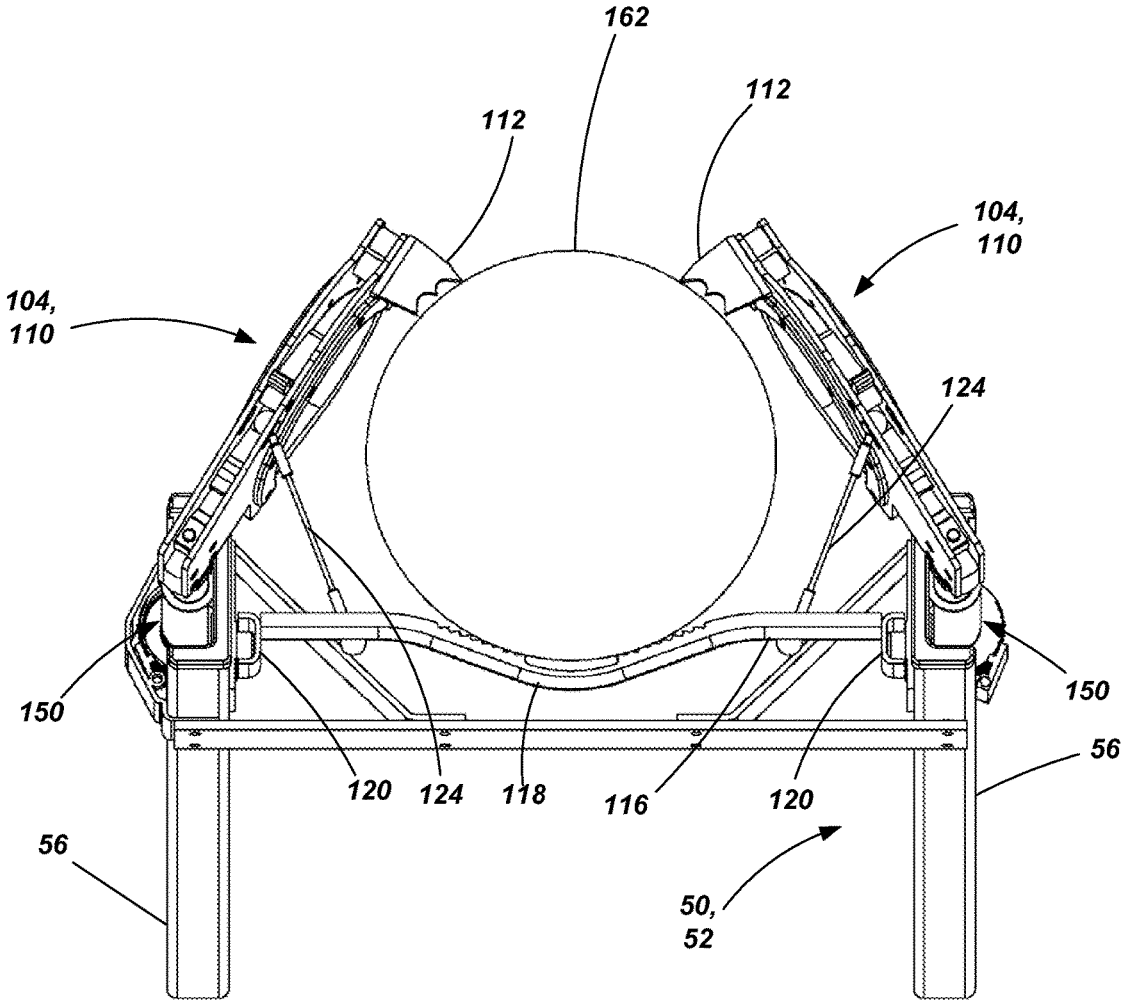

Referring to FIG. 6B, use of the securing apparatus 100 to grasp a pole 162 having a slightly large diameter (e.g., approximately 8 inches) is shown. In this case, the same apparatus 100 may be used to grasp the pole 162 (and in substantially the same manner as described with respect the six inch pole 160), but the pole grasping structures 112 engage a surface of the pole 162 at a location between the rearmost portion of the pole 162 and the sides of the pole (e.g., between approximately 10 o'clock and 11 o'clock and between approximately 1 o'clock and 2 o'clock when considering the cross-section of the pole as the face of a clock).

Figure 6C:
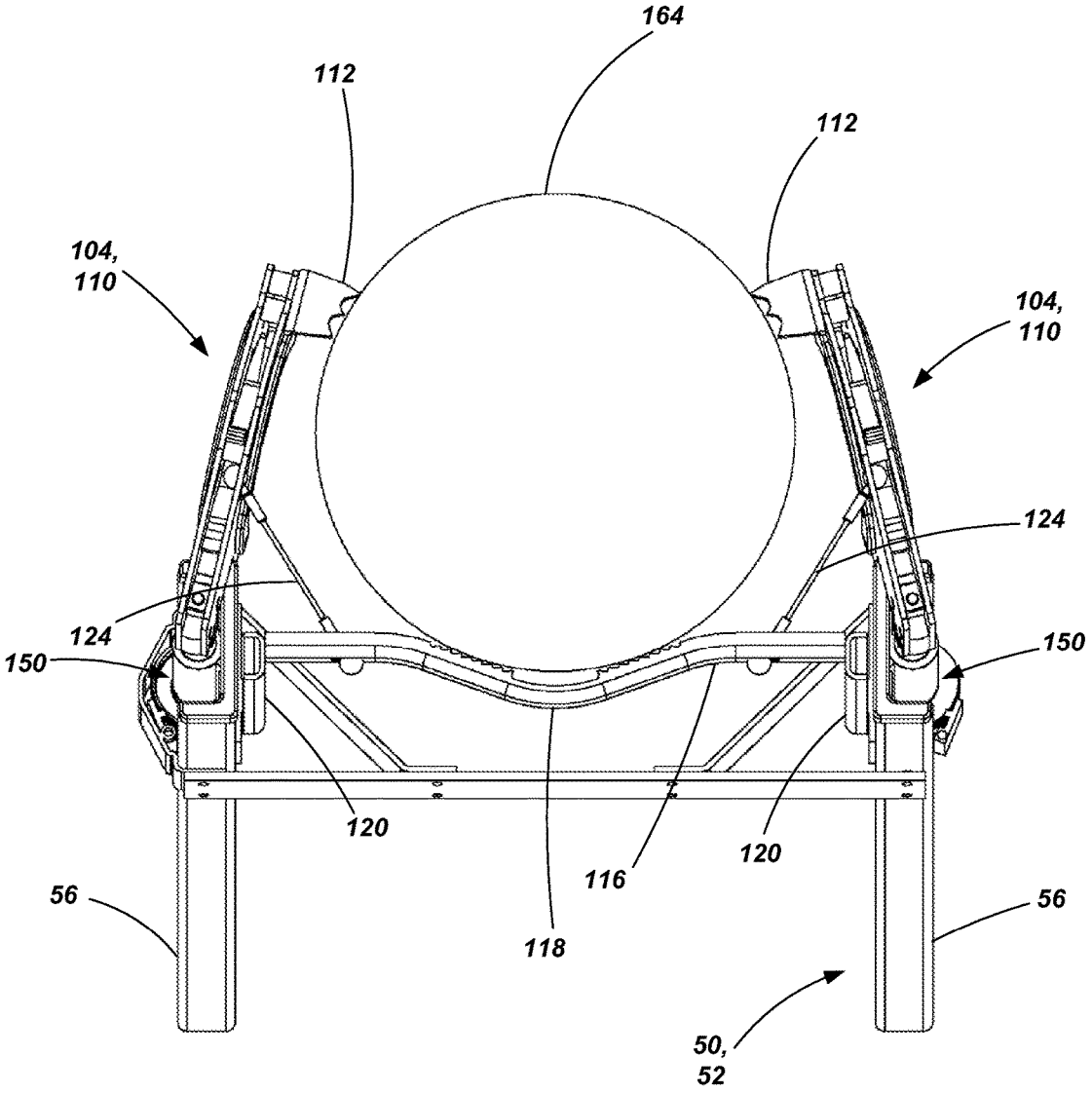

Referring to FIG. 6C, use of the securing apparatus 100 to grasp a pole 164 with an increased diameter (e.g., approximately 10 inches) is shown. In this case, the same apparatus 100 may be used to grasp the pole 164 (and in substantially the same manner as described with respect the other poles 160 and 162), but the pole grasping structures 112 engage a surface of the pole 164 at a location a little closer to the sides of the pole 164 (e.g., at approximately 10 o'clock and 2 o'clock).

Figure 6D:
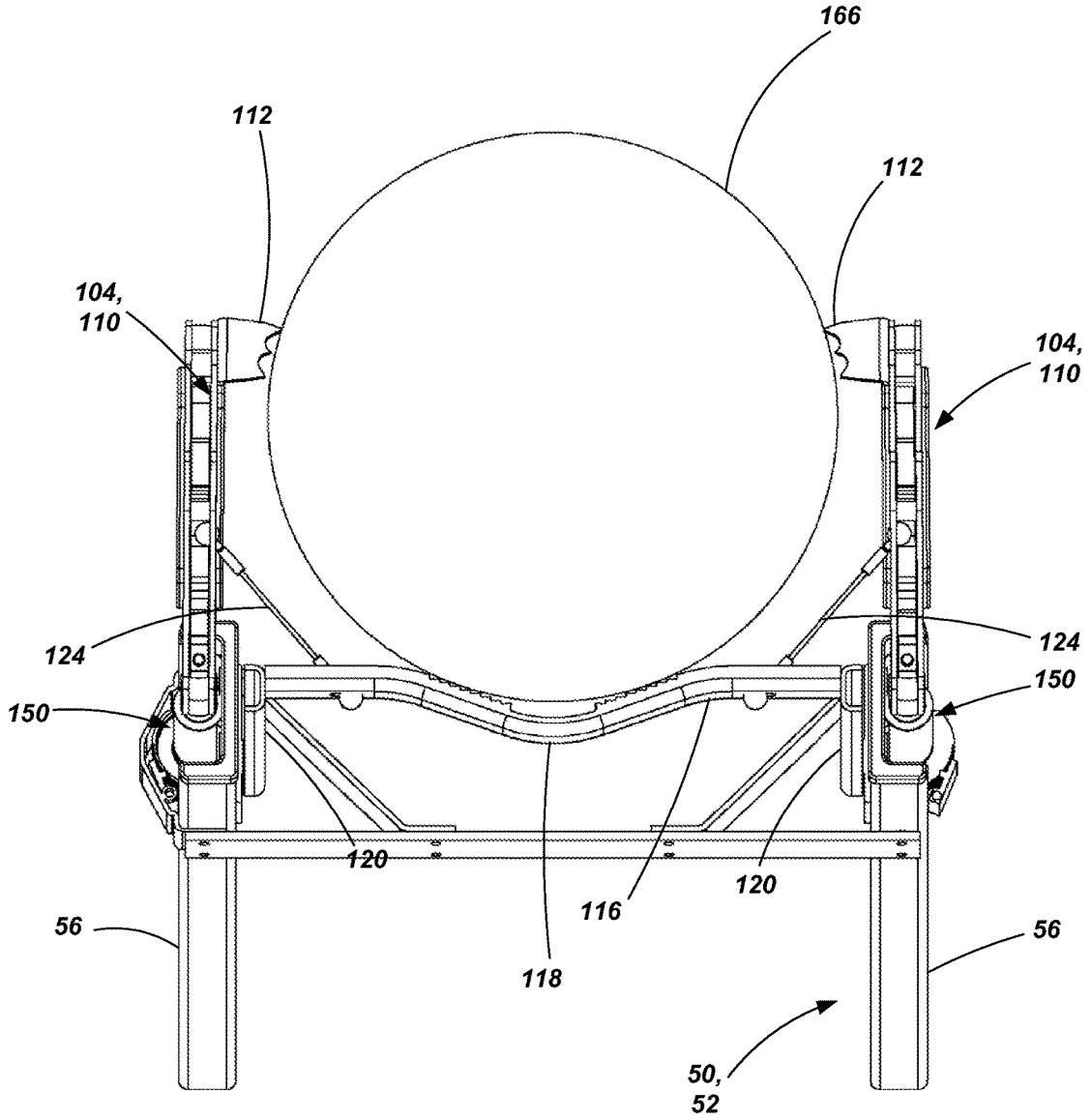

Referring to FIG. 6D, use of the securing apparatus 100 to grasp another pole 166 with an increased diameter (e.g., approximately 12-14 inches) is shown. In this case, the same apparatus 100 may be used to grasp the pole 166 (and in substantially the same manner as described with respect the other poles 160, 162 and 164), but the pole grasping structures 112 engage a surface of the pole 166 at a location generally along the sides of the pole 166 and slightly to the rear of the pole (e.g., between approximately 10 o'clock and 9 o'clock and between approximately 2 o'clock and 3 o'clock).

Figure 6E:
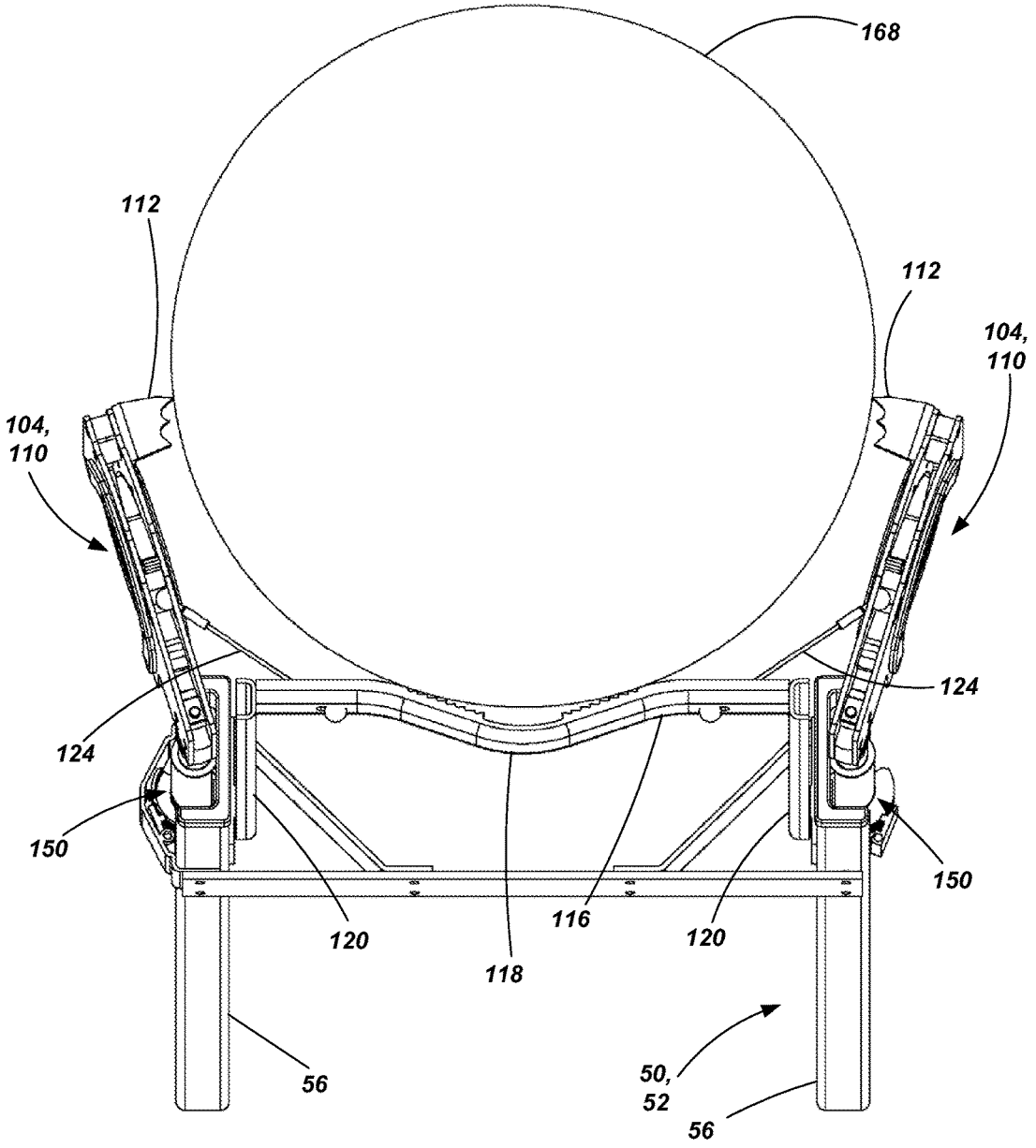

Referring to FIG. 6E, use of the securing apparatus 100 to grasp another pole 168 with an increased diameter (e.g., approximately 16-18 inches) is shown. In this case, the same apparatus 100 may be used to grasp the pole 168 (and in substantially the same manner as described with respect the other poles 160, 162, 164 and 166), but the pole grasping structures 112 engage a surface of the pole 168 at a location slightly toward the front of the pole 168 (e.g., between approximately 9 o'clock and 8 o'clock and between approximately 3 o'clock and 4 o'clock).

Thus the securing apparatus 100 may be used to engage either horizontal support structures (e.g. cables) or vertical support structures (e.g., utility poles) of various sizes and configurations. A release mechanism (e.g., a pull cord, shaft, or other mechanism such as described above) that may be remotely actuated may be configured to release either or both the engagement members 130 and the rotational positions of the engagement mechanisms 104. Such a configuration enables a user to keep the ladder 50 in a safe and supported state until they descend from the ladder and desire to release the ladder from its engaged state.

Figure 7A:
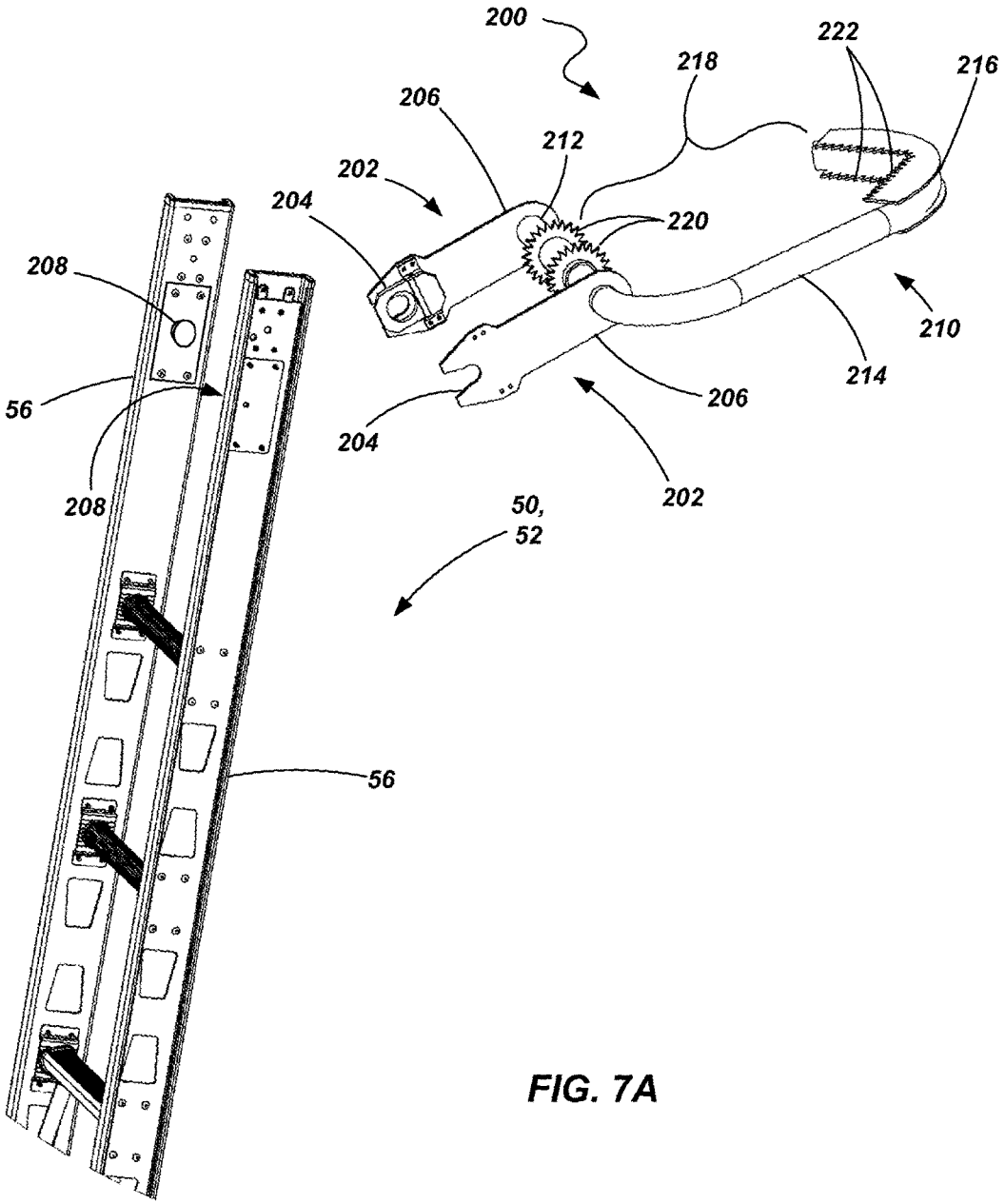
FIGS. 7A-7C are various views of a securing apparatus that may be used with a ladder in accordance with another embodiment of the invention.
Figure 7B:
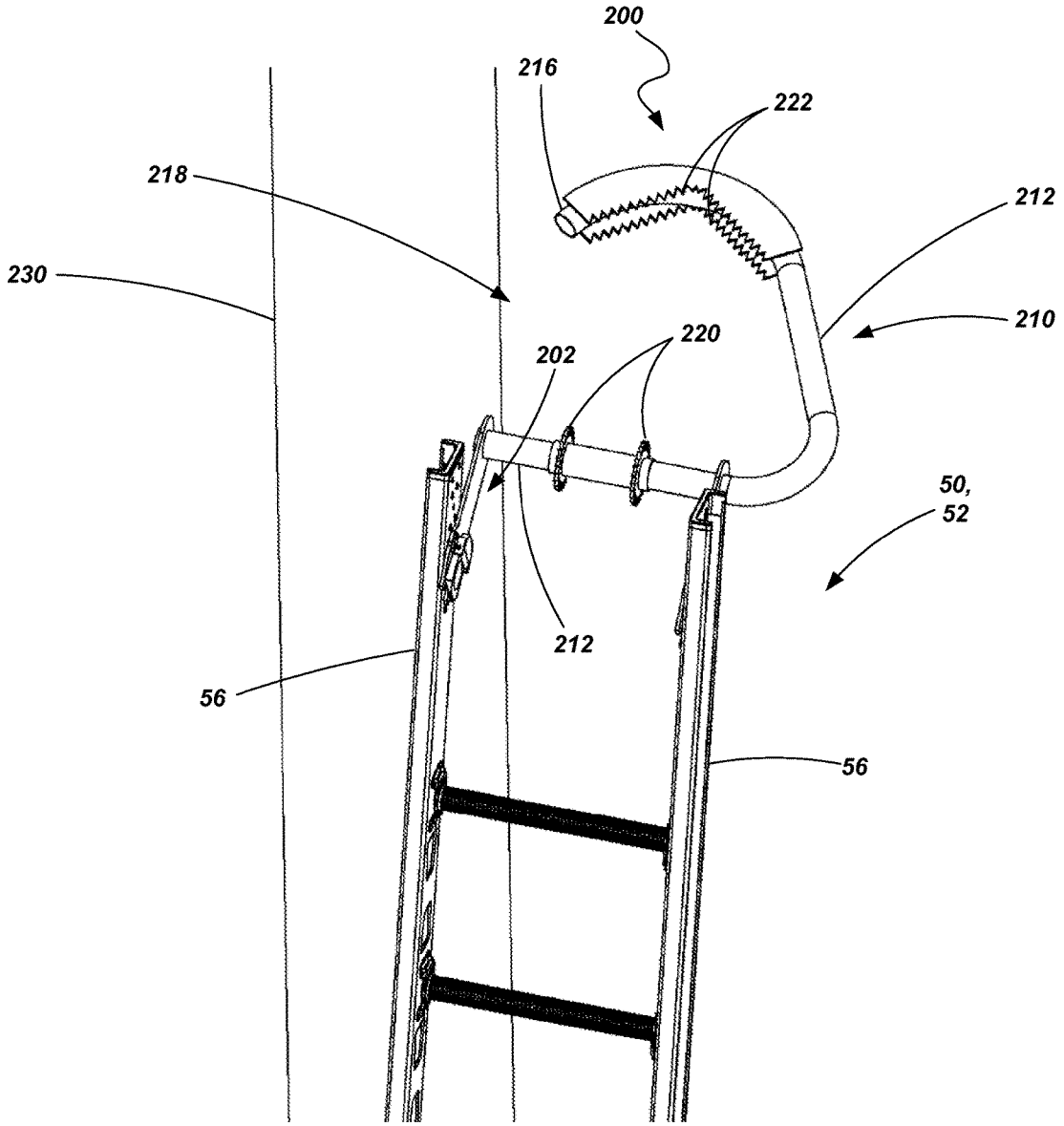
Figure 7C:
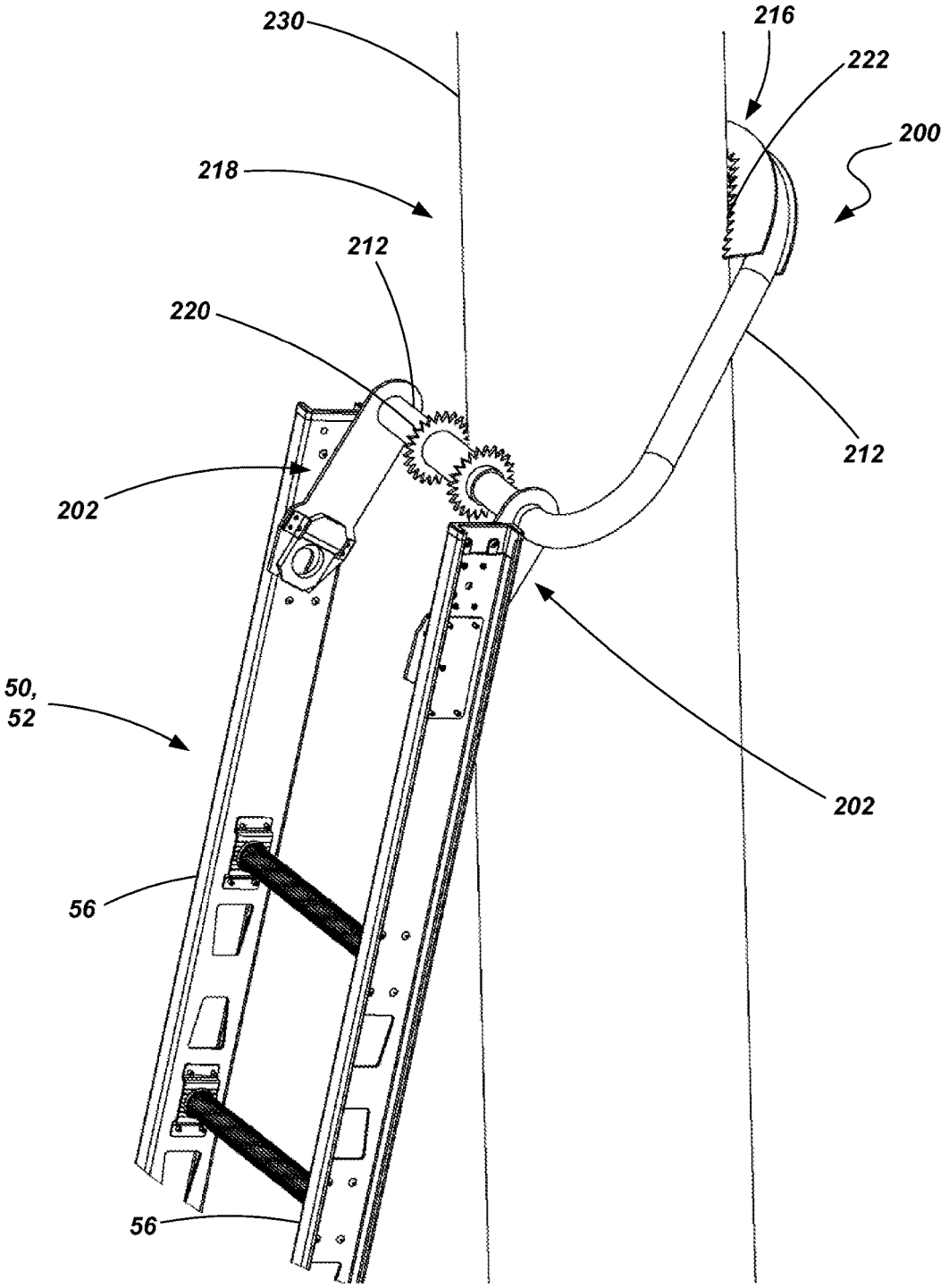

Referring now to FIGS. 7A-7C, another securing apparatus 200 is shown attached to the top of a ladder 50. The securing apparatus 200 is configured to engage a vertical support (e.g., a utility pole) and may be used alone or in combination with other mechanisms including, for example, mechanisms such as those described in the '927 Application. The securing apparatus 200 includes a pair of brackets 202 for coupling with the ladder 50. The brackets include a coupling portion 204 attached to an arm 206. As seen in FIG. 7A, the ladder 50 may include coupling brackets 208 associated with ladder rails 56. The coupling portion 204 of the brackets 202 are configured to releasably engage the coupling brackets 208 of the ladder 50. Additionally, when the securing apparatus 200 is coupled with the ladder 50 via the coupling brackets 208, the securing apparatus 200 may pivot or rotate relative to the coupling brackets 208. More specifically, the arms 206 of the brackets may pivot about a shaft or other component of the coupling brackets 208 so that the arms 206 pivot relative to the rails 56 of the ladder 50.

The securing apparatus further includes an engagement arm 210 coupled with the arms 206 of the brackets 202. In some embodiments, the engagement arm 210 may be substantially C-shaped or U-shaped. In the embodiment shown, the engagement arm 210 displays a geometry that may be described as a truncated triangular shape having a first section 212 (e.g., a first leg of the triangle) extending between and coupled with the brackets 202, a second section 214 extending generally away from the brackets 202 at an acute angle relative to the first section 212 (e.g., a second leg of the triangle), and a third section 216 bending around from the second section 214 and ending (e.g., forming a truncated third leg of the triangle). The engagement arm 210 defines an opening or a gate 218 between the first section 212 and the third section 216.

One or more engagement features 220 (e.g., teeth, barbs, serrated edges or other features) may be associated with the first section 212 of the engagement arm 210 and one or more engagement features 222 may be associated with the third section 216 of the engagement arm 210. In the embodiment shown, the engagement features 220 associated with the first section may include a pair of discs having teeth or barbs formed along their radially outward periphery. The discs may be configured to rotate relative to the engagement arm 210 (i.e., rotate about the first section 212 of the engagement arm 210) to assist in positioning the ladder 50 and securing apparatus 200 relative to a pole or other vertical support member. Additionally, in the embodiment shown, the engagement features 222 associated with the third section 216 may include a plurality of teeth or barbs formed along a substantially v-shaped member coupled with or integrally formed with third section 216.

In use, the securing apparatus may be configured to extend from the rails 56 of the ladder 50 at an acute angle (i.e., an angle less than 90°) and the ladder 50 and securing apparatus 200 may be positioned adjacent a pole 230 or other vertical support structure such that the opening or gate 218 is positioned adjacent the pole 230 as seen in FIG. 7B. The ladder 50 and securing apparatus 200 may then be displaced laterally such that the pole 230 passes through the gate 218 defined by the engagement arm 210. The engagement features 220 of the first section 212 may be placed in contact with the pole 230 and the ladder 50 may then be adjusted in terms of its climbing angle (e.g., by displacing the feet of the ladder 50 away from the pole 230) causing the engagement arm 210 to pivot relative to the rails 56 of the ladder 50 such that the engagement features 222 of the third section 216 contact the pole 230 as shown in FIG. 7C. The ladder 50 is then securely supported by the pole 230 with the engagement features 220 and 222 engaged with the pole 230 and with the gate 218 of the engagement arm 210 being placed at an angle relative to the longitudinal axis of the pole 230 such that the diameter of the pole 230 is too large to pass out of the gate 218. Removal of the ladder 50 from the pole is substantially the reverse of installation, with the ladder being adjusted relative to the pole 230 such that the engagement arm 210 pivots downward, the engagement features 222 of the third section 216 disengaging the pole 230, and the gate 218 widening or opening (due to the angle of the engagement arm 210 relative to the pole) such that the pole 230 may pass back through the gate 218 when the ladder is laterally displaced relative to the pole 230.

While the invention may be susceptible to various modifications and alternative forms, specific embodiments have been shown by way of example in the drawings and have been described in detail herein. However, it should be understood that the invention is not intended to be limited to the particular forms disclosed. Rather, the invention includes all modifications, equivalents, and alternatives falling within the spirit and scope of the invention as defined by the following appended claims.

What is claimed is:

1. A ladder comprising:

a first pair of spaced apart rails;

a plurality of rungs extending between and coupled to the first pair of spaced apart rails;

a securing apparatus comprising:

a pair of spaced apart engagement mechanisms, each engagement mechanism being pivotally coupled with an associated rail of the first pairs of spaced apart rails, each engagement mechanism comprising:

a frame member, an engagement member pivotally coupled with the frame member wherein each engagement member is configured to rotate from an open position, wherein an open gate is formed between the engagement member and its associated frame member, to a closed position wherein the engagement member and the frame member cooperatively form an enclosed structure, a pole grasping structure coupled with the frame member, an actuating mechanism comprising a cross-member having opposed ends attached to a respective spaced apart rail and coupled with each of the engagement mechanisms by a pair of link members, each link member having a first end attached to the cross-member at a location spaced inwardly form a respective end of the cross-member and a second end attached to an associated one of the pair of engagement members such that, upon displacement of the cross-member in a first direction towards a front face of the ladder, the engagement mechanisms rotate inwardly toward the cross-member;

wherein each engagement mechanism is configured to rotate into a stored position wherein, when each engagement mechanism is in the stored position, the cross-member and each engagement mechanism are all substantially positioned within an envelope defined by the spaced apart rails.

2. The ladder of claim 1, further comprising a ratchet mechanism associated with each of the pivotal engagement mechanisms, wherein each ratchet mechanism is configured to selectively maintain an associated one of the engagement mechanisms in a plurality of rotational positions between a first deployed position and the stored position.

3. The ladder of claim 2, wherein each engagement mechanism further includes a retaining mechanism configured to selectively maintain the engagement member in the closed position.

4. The ladder of claim 3, further comprising a release mechanism configured to actuate at least one of the retaining mechanism and the ratchet mechanism of at least one engagement mechanism of the pair of engagement mechanisms.

5. The ladder of claim 4, wherein the release mechanism is configured to actuate both the retaining mechanism and the ratchet mechanism of the at least one engagement mechanism.

6. The ladder of claim 1, wherein, when each engagement mechanism is in the stored position, each pole grasping structure is positioned adjacent the cross-member.

7. The ladder claim 1, wherein the cross-member includes a v-shaped portion and at least one engagement feature.

8. The ladder of claim 7, wherein, when each engagement mechanism is in the stored position, each pole grasping structure is positioned adjacent the v-shaped portion of the cross-member.

9. The ladder of claim 1, wherein each pole grasping structure includes at least one engagement feature selected from the group consisting of teeth, barbs or a serrated edge.

10. The ladder of claim 1, further comprising:

a second pair of spaced apart rails slidably coupled with the first pair of spaced apart rails; and a plurality of rungs extending between and coupled to the second pair of spaced apart rails.

* * * * *